US009211229B2

(12) United States Patent
Illindala

(10) Patent No.: US 9,211,229 B2
(45) Date of Patent: Dec. 15, 2015

(54) PISTON-BASED CHEST COMPRESSION DEVICE WITH BELT DRIVE

(71) Applicant: ZOLL Circulation, Inc., Sunnyvale, CA (US)

(72) Inventor: Uday Kiran V. Illindala, Sunnyvale, CA (US)

(73) Assignee: ZOLL Circulation, Inc., San Jose, CA (US)

( * ) Notice: Subject to any disclaimer, the term of this patent is extended or adjusted under 35 U.S.C. 154(b) by 244 days.

(21) Appl. No.: 13/971,727

(22) Filed: Aug. 20, 2013

(65) Prior Publication Data

US 2015/0057580 A1 Feb. 26, 2015

(51) Int. Cl.
*A61H 3/00* (2006.01)
*A61H 31/00* (2006.01)

(52) U.S. Cl.
CPC ..... *A61H 31/006* (2013.01); *A61H 2201/1215* (2013.01)

(58) Field of Classification Search
CPC ... A61H 31/00; A61H 31/005; A61H 31/006; A61H 31/008; A61H 2201/1215; A61H 2201/5058; A61H 2201/0184; A61H 2201/0161; A61H 2201/1664; A61H 2201/5007; A61H 2201/5046; A61H 2201/5064; A61H 2201/5084; A61H 2201/5092; A61H 2201/5097; A61H 2201/0173; A61H 2031/003
USPC ..... 601/41–44
See application file for complete search history.

(56) References Cited

U.S. PATENT DOCUMENTS

| | | | | |
|---|---|---|---|---|
| 3,374,783 | A * | 3/1968 | Hurvitz | 601/97 |
| 5,287,846 | A * | 2/1994 | Capjon et al. | 601/44 |
| 5,743,864 | A | 4/1998 | Baldwin, II | |
| 6,066,106 | A | 5/2000 | Sherman et al. | |
| 6,142,962 | A | 11/2000 | Mollenauer et al. | |
| 6,398,745 | B1 | 6/2002 | Sherman et al. | |
| 6,616,620 | B2 | 9/2003 | Sherman et al. | |
| 7,122,014 | B2 | 10/2006 | Palazzolo et al. | |
| 7,226,427 | B2 | 6/2007 | Steen | |
| 7,347,832 | B2 | 3/2008 | Jensen et al. | |
| 7,354,407 | B2 | 4/2008 | Quintana et al. | |
| 7,410,470 | B2 | 8/2008 | Escudero et al. | |
| 7,569,021 | B2 | 8/2009 | Sebelius et al. | |
| 7,775,996 | B2 * | 8/2010 | Stromsnes | 601/41 |
| 2004/0002667 | A1 | 1/2004 | Sherman et al. | |
| 2004/0181179 | A1 * | 9/2004 | Hwang | 601/44 |

(Continued)

FOREIGN PATENT DOCUMENTS

WO WO03024336 3/2003

*Primary Examiner* — Quang D Thanh
(74) *Attorney, Agent, or Firm* — K. David Crockett, Esq.; Paul J. Backofen, Esq.; Crockett & Crockett, PC

(57) ABSTRACT

A hybrid chest compression device includes a backboard with a motor and a drive spool housed within the backboard. There is also a piston support frame secured to the backboard forming a patient channel between the piston support frame and the backboard. There is a belt operably secured to the drive spool and enclosed within the backboard and the piston support frame and a piston operably housed within the piston support frame wherein motion of the belt actuates motion of the piston. Actuation of the motor results in cyclic rotation and counter-rotation of the motor and corresponding winding and unwinding of the belt on the drive spool to effectuate cyclic extension and retraction of the piston against the patient's chest to perform mechanical cardiopulmonary resuscitation.

4 Claims, 6 Drawing Sheets

(56) References Cited

U.S. PATENT DOCUMENTS

| | | | |
|---|---|---|---|
| 2009/0187123 | A1 | 7/2009 | Hwang et al. |
| 2009/0260637 | A1 | 10/2009 | Sebelius et al. |
| 2010/0004572 | A1 | 1/2010 | King |
| 2010/0185127 | A1 | 7/2010 | Nilsson et al. |
| 2013/0072830 | A1 | 3/2013 | Illindala et al. |

* cited by examiner

PISTON-BASED CHEST COMPRESSION DEVICE WITH BELT DRIVE

FIELD OF THE INVENTIONS

The inventions described below relate to the field of cardiopulmonary resuscitation (CPR) chest compression devices.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or bag mask respiration, is used to supply air to the lungs. When a first aid provider performs manual chest compression effectively, blood flow in the body is about 25% to 30% of normal blood flow.

In efforts to provide better blood flow and increase the effectiveness of bystander resuscitation efforts, various mechanical devices have been proposed for performing CPR. Among the variations are pneumatic vests, hydraulic and electric piston devices as well as manual and automatic belt drive chest compression devices.

Piston-based chest compression systems are illustrated in Nilsson, et al., CPR Device and Method, U.S. Patent Publication 2010/0185127 (Jul. 22, 2010), Sebelius, et al., Support Structure, U.S. Patent Publication 2009/0260637 (Oct. 22, 2009), Sebelius, et al., Rigid Support Structure on Two Legs for CPR, U.S. Pat. No. 7,569,021 (Aug. 4, 2009), Steen, Systems and Procedures for Treating Cardiac Arrest, U.S. Pat. No. 7,226,427 (Jun. 5, 2007) and King, Gas-Driven Chest Compression Device, U.S. Patent Publication 2010/0004572 (Jan. 7, 2010) all of which are hereby incorporated by reference.

Our own patents, Mollenauer et al., Resuscitation device having a motor driven belt to constrict/compress the chest, U.S. Pat. No. 6,142,962 (Nov. 7, 2000); Sherman, et al., CPR Assist Device with Pressure Bladder Feedback, U.S. Pat. No. 6,616,620 (Sep. 9, 2003); Sherman et al., Modular CPR assist device, U.S. Pat. No. 6,066,106 (May 23, 2000); and Sherman et al., Modular CPR assist device, U.S. Pat. No. 6,398,745 (Jun. 4, 2002), and Escudero, et al., Compression Belt System for Use with Chest Compression Devices, U.S. Pat. No. 7,410,470 (Aug. 12, 2008), show chest compression devices that compress a patient's chest with a belt. Our commercial device, sold under the trademark AUTOPULSE®, is described in some detail in our prior patents, including Jensen, Lightweight Electro-Mechanical Chest Compression Device, U.S. Pat. No. 7,347,832 (Mar. 25, 2008) and Quintana, et al., Methods and Devices for Attaching a Belt Cartridge to a Chest Compression Device, U.S. Pat. No. 7,354,407 (Apr. 8, 2008).

SUMMARY

The devices and methods described below provide for a chest compression device using a piston to compress the chest, while using a belt configuration similar to that used for the AutoPulse® chest compression device. Cyclic winding and unwinding of a belt passing through the frame which supports the piston actuates the piston to provide resuscitative chest compressions.

The hybrid chest compression device includes a backboard with a motor and a drive spool housed within the backboard.

The motor is operably secured to the drive spool to cyclically wind and unwind the belt which is enclosed within the backboard and the piston support frame and is secured to the drive spool. The piston support frame has two legs and a piston actuator housing and the frame is secured to the backboard forming a channel between the two legs, the backboard and the piston actuator housing to accommodate the patient. The piston is operably housed within the piston actuator housing and the piston is driven by movement of the belt. Two or more sets of guide spindles are located in the backboard and the piston support frame for guiding the belt and forming a belt path through the backboard and the piston support frame. Actuation of the motor results in cyclic rotation and counter-rotation of the motor and corresponding winding and unwinding of the belt on the drive spool to effectuate cyclic extension and retraction of the piston against the patient's chest to perform mechanical chest compressions for cardiopulmonary resuscitation.

Alternatively, the belt may be driven by a pneumatic piston with small volumes of air at pressures regularly supplied in hospitals.

DETAILED DESCRIPTION OF THE INVENTIONS

Figure 1:
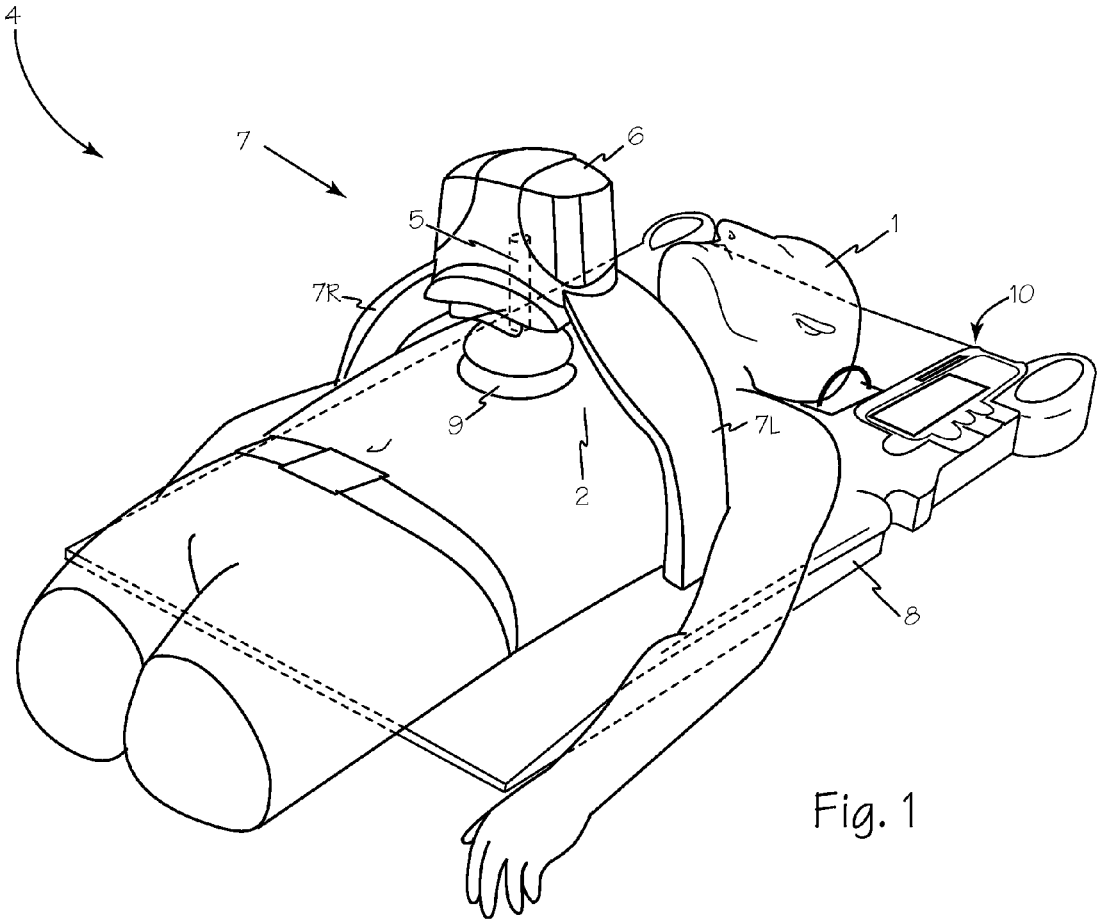
FIG. 1 is a perspective view of the chest compression device engaging a patient.
Figures 2, 2A:
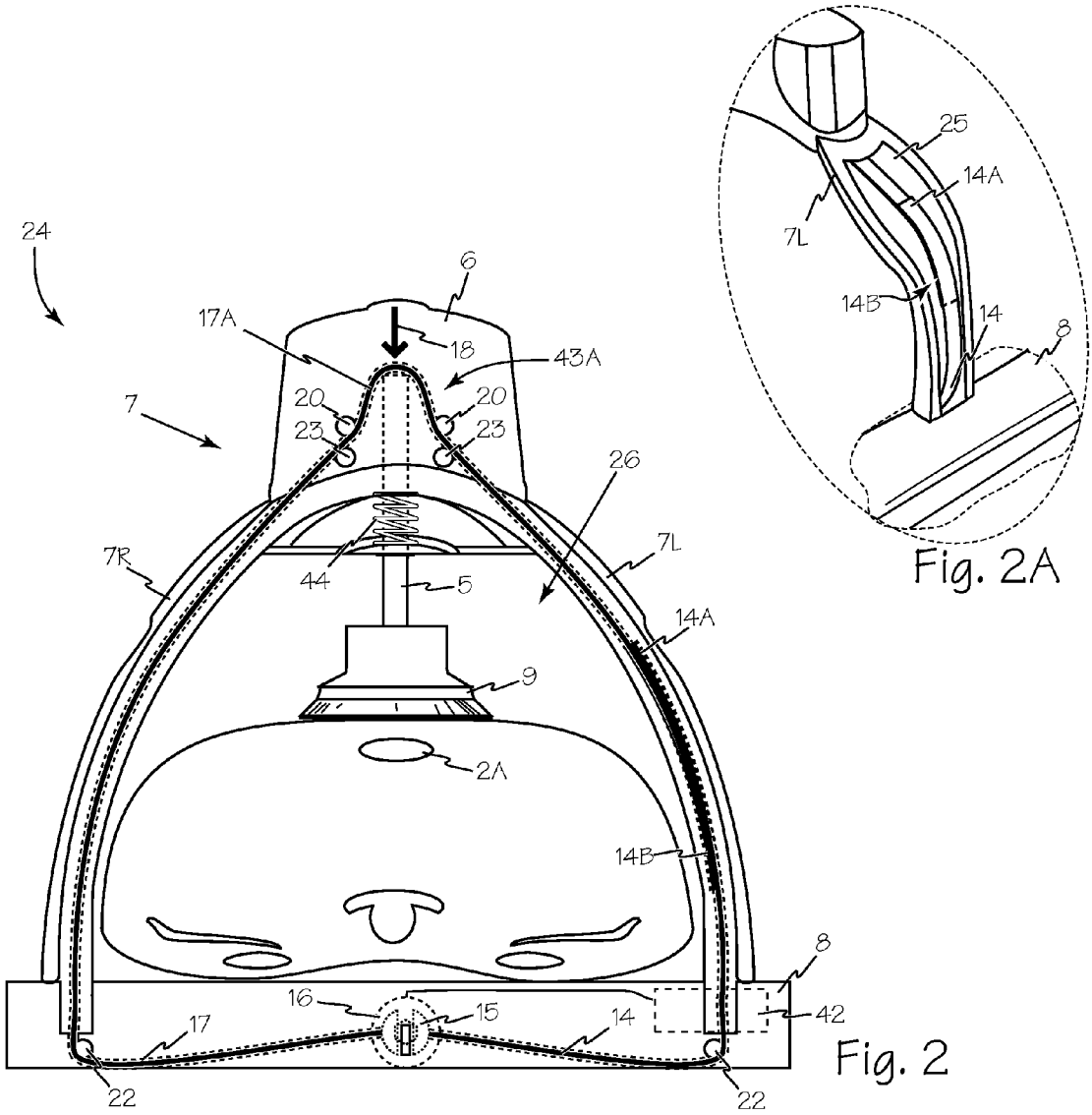
FIG. 2 is an end view of an alternate chest compression device ready to commence compressions.
FIG. 2A is a perspective view of a support leg of the chest compression device of FIG. 2 illustrating belt end access.

FIG. 1 illustrates the chest compression device fitted on a patient 1. The chest compression device 4 applies compressions with the piston 5. The piston is disposed within a housing 6 which is supported over the patient with a frame or gantry 7 with two legs 7L and 7R fixed to a backboard 8. When disposed about the patient, the frame extends over thorax 2 of the patient so that the piston is disposed apposing sternum 2A of the patient as shown in FIG. 2. Piston 5 may include a compression pad 9 adapted to contact the patient's chest, directly over the sternum, to impart compressive force on the patient's chest. The chest compression device is controlled using a control system which is operated by a rescuer through interface 10, which may include a display to provide instructions and prompts to a rescuer and includes an input device to accept operating instructions from the rescuer.

As illustrated in FIG. 2, piston 5 is driven by a belt 14 which is tightened and loosened when spooled upon a drive spool 15. The drive spool is mounted in the housing used as the backboard 8. Motor 16 within backboard 8 is operably connected to drive spool 15. The belt is connected to drive spool 15 such that cyclic rotation of motor 16 cyclically rotates drive spool 15 which spools and unspools belt 14 onto and off of drive spool 15. This spooling and unspooling may also be described as winding and unwinding or wrapping and unwrapping. The cyclic spooling and unspooling of belt 14 onto and off of drive spool 15 cyclically shortens and lengthens the span of belt 14 surrounding patient 1. The path or course of belt 14, such as path 17, through backboard 8, frame 7 and piston housing 6 has a fixed length such that shortening the span of belt 14 from span 17A to span 17B (shown in FIG. 5) causes belt 14 to exert compressive force 18 on piston 5. Cyclic spooling and unspooling of belt 14 onto and off of drive spool 15 causes cyclic exertion of compressive force 18 to piston 5, and from piston 5 to patient's sternum 2A.

Belt path 17 may optionally include guide spindles to control belt 14 and belt path 17 and minimize friction on the belt when belt 14 moves through the frame, backboard and piston housing. For example, upper guide spindles 20 and lower guide spindles 22 minimize friction and constrain belt path 17. Any suitable number of guide spindles may be provided throughout backboard 8, support frame 7 and piston housing 6 such as intermediate guide spindles 23 which may also be provided within piston housing 6.

To engage a patient in chest compression device 4 of FIG. 1, chest compression device 4 may be slid over patient 1 until the patient is oriented with piston 5 apposing sternum 2A. Alternatively, chest compression device 24 shown in FIGS. 2 and 2A may include access opening 25 in at least one support leg such as support leg 7L. Belt 14 has first and second ends 14A and 14B respectively which overlap and are accessible through access opening 25. First and second belt ends 14A and 14B each include cooperating attachment elements such as hook and loop fasteners or other suitable fasteners. Separation of first belt end 14A from second belt end 14B permits support leg 7L to be lifted free of backboard 8. Patient 1 is then oriented on backboard 8, support leg 7L is reengaged to backboard 8 with patient 1 extending through access opening or channel 26, first and second belt ends 14A and 14B are reconnected to each other and chest compression device 24 is ready to provide chest compressions to patient 1.

Figure 3:
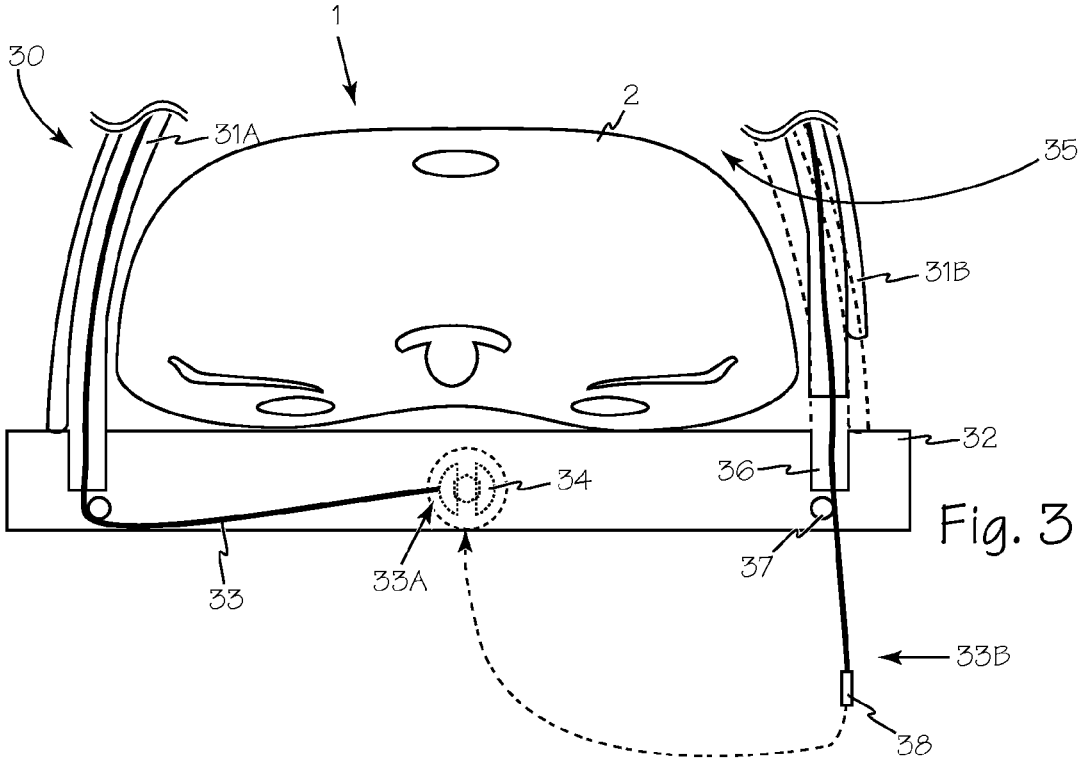
FIG. 3 is an end view of another alternate chest compression device illustrating an alternate belt attachment configuration.

Chest compression device 30 of FIG. 3 illustrates another configuration for opening the chest compression device to engage a patient such as patient 1. First support leg 31A is attached to backboard 32 using any suitable attachment mechanism and first end 33A of belt 33 is attached to drive spool 34 while belt second end 33B is removably attached to the drive spool to enable insertion of a patient into patient channel 35. Second support leg 31B frictionally engages leg socket 36 of backboard 32. Belt second end 33B passes through socket 36, around one or more guide spindles such as guide spindle 37, and is removably attached to drive spool 34 using a clip, spline or other suitable attachment means such as clip 38. With belt second end 33B disengaged from drive spool 34, second support leg 31B is disengaged from socket 36. Second support leg 31B with belt second end 33B extending from the leg is moved to enable insertion of patient 1 into patient channel 35. When patient 1 is properly oriented on backboard 32, belt second end 33B is passed through socket 36 and second support leg 31B is inserted into socket 36. Belt second end 33B passes around guide spindle 37 and clip 38 is then secured to drive spool 34 and chest compression device 30 is ready to perform mechanical CPR.

Figure 4:
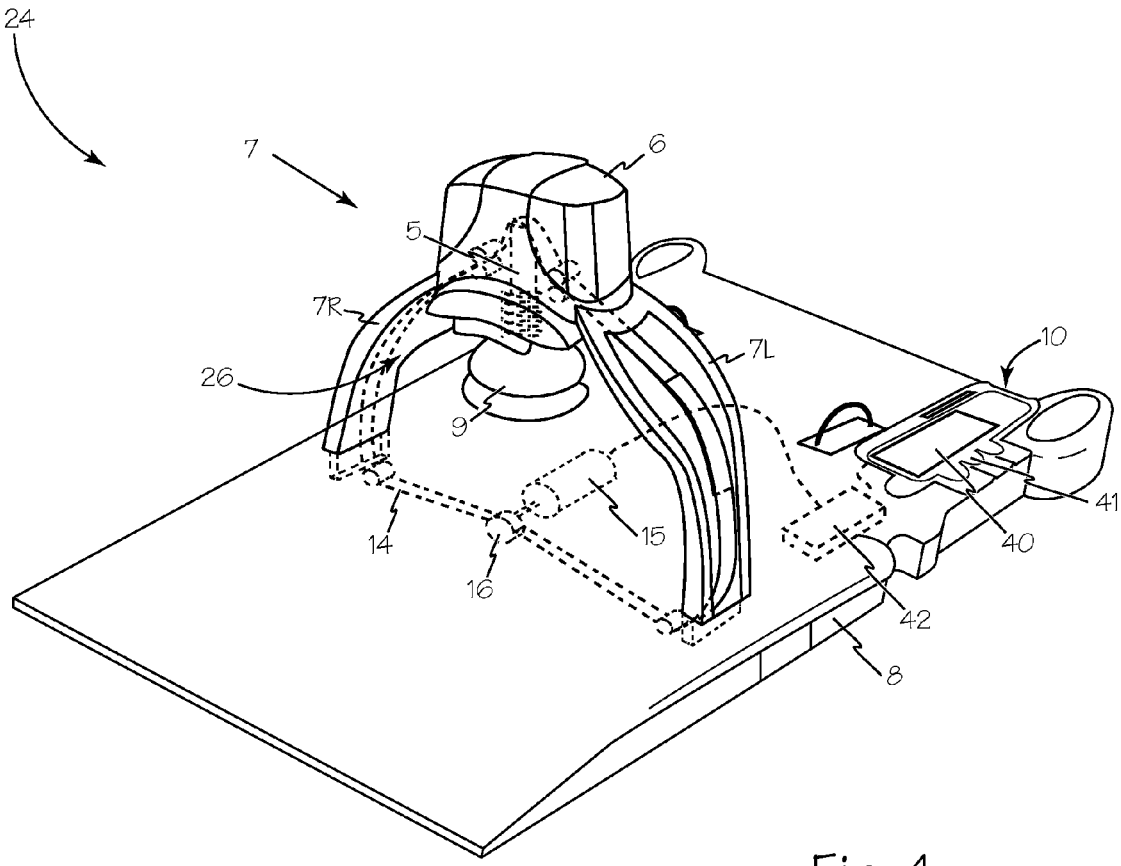
FIG. 4 is a perspective view of a chest compression device.

Referring now to FIG. 4, when a patient is properly oriented within any of chest compression devices 4, 24 or 30, activation of the device is accomplished using interface 10. Displays such as display 40 provides prompts, alerts and or instructions to an operator. Input controls 41 accept operating instructions from the operator. When chest compression is activated in the device, controller 42 actuates and controls operation of motor 16 and other elements or components of chest compression device 24. Rotation of motor 16 rotates drive spool 15 which spools and unspools belt 14 to cause piston 5 to exert compressive force on a patient. Controller 42 may include one or more sets of instructions, procedures or algorithms to control actuation and operation of the motor and other elements or components of device 24.

Figure 5:
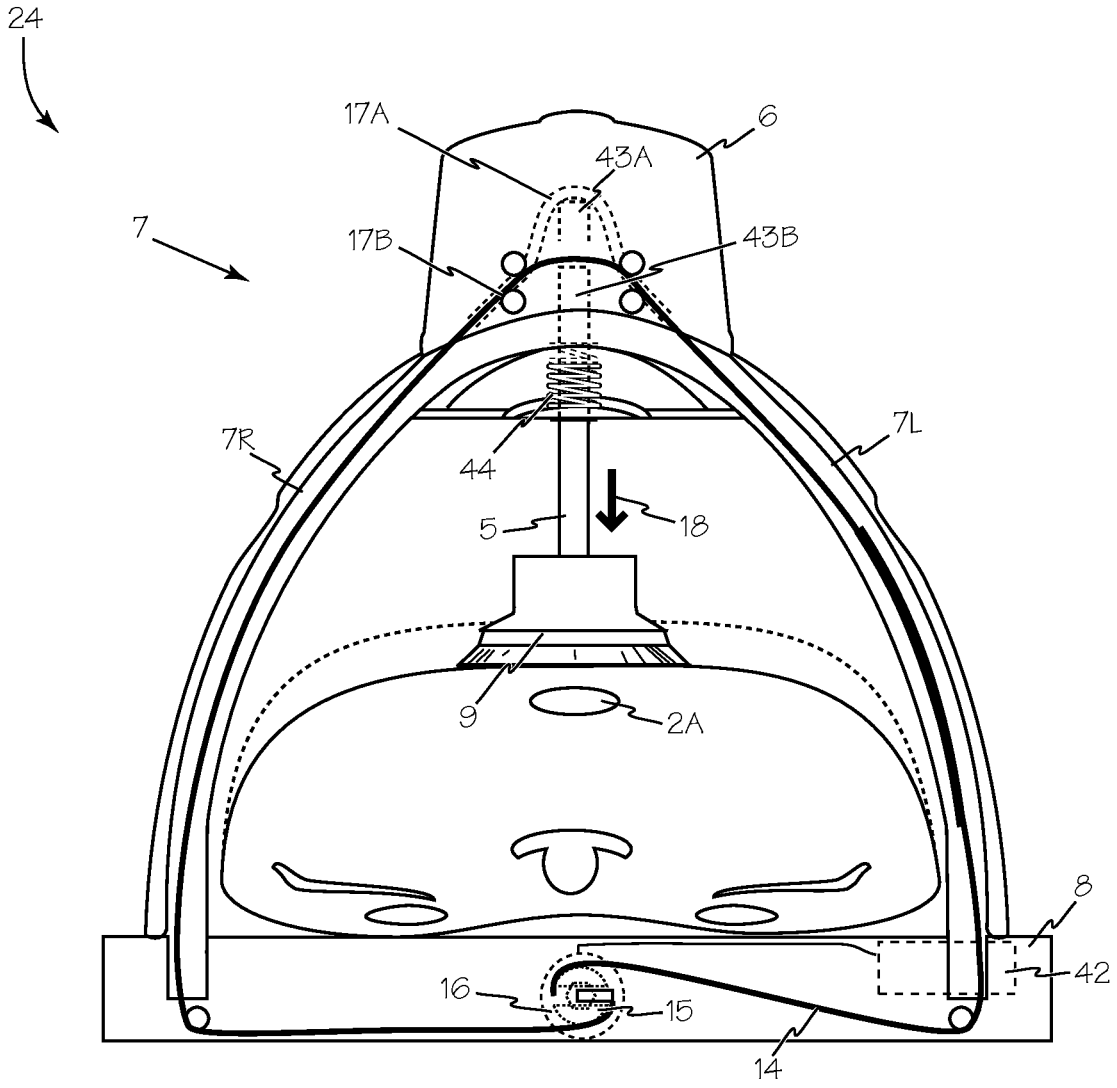
FIG. 5 is an end view of a chest compression device with the belt and piston illustrated at full compression.

As illustrated in FIGS. 2 and 5, operation of any of chest compression devices 4, 24 or 30, results in a controller such as controller 42 controlling operation of motor 16. Motor 16 which is operably connected to drive spool 15 rotates first clockwise, and then counter-clockwise. Alternatively, counter rotation of the drive spool may be accomplished with a releasing clutch and a spring return, a motor driven return or other suitable mechanism. The drive belt such as drive belt 14 is operably connected to drive spool 15 such that the alternating rotation and counter-rotation first spools or winds the belt onto the drive spool and then unspools or unwinds the belt from the drive spool. The cyclic spooling and unspooling of the belt cyclically shortens and lengthens the span of the belt as discussed above. When the belt span is at its maximum, belt 14 and piston 5 are in position 43A as illustrated FIG. 2. Rotation of the motor and drive spool which spools or winds belt 14 onto the drive spool shortens the span of the belt to span 17B and urges piston 5 into fully extended position 43B of FIG. 5. In position 43B, piston 5 compresses patient's thorax 2 with compressive force 18 applied to sternum 2A. Counter-rotation of drive spool 15 releases tension on belt 14 and the resilience of the patient's thorax will cause decompression of the thorax which will urge piston 5 back into position 43A. Alternatively, any suitable spring such as spring 44 may be compressed by the extension of piston 5 into position 43B. The force of compressed spring 44 and release of tension on belt 14 will urge piston 5 back into retracted position 43A and may assist in chest decompression.

Figure 6:
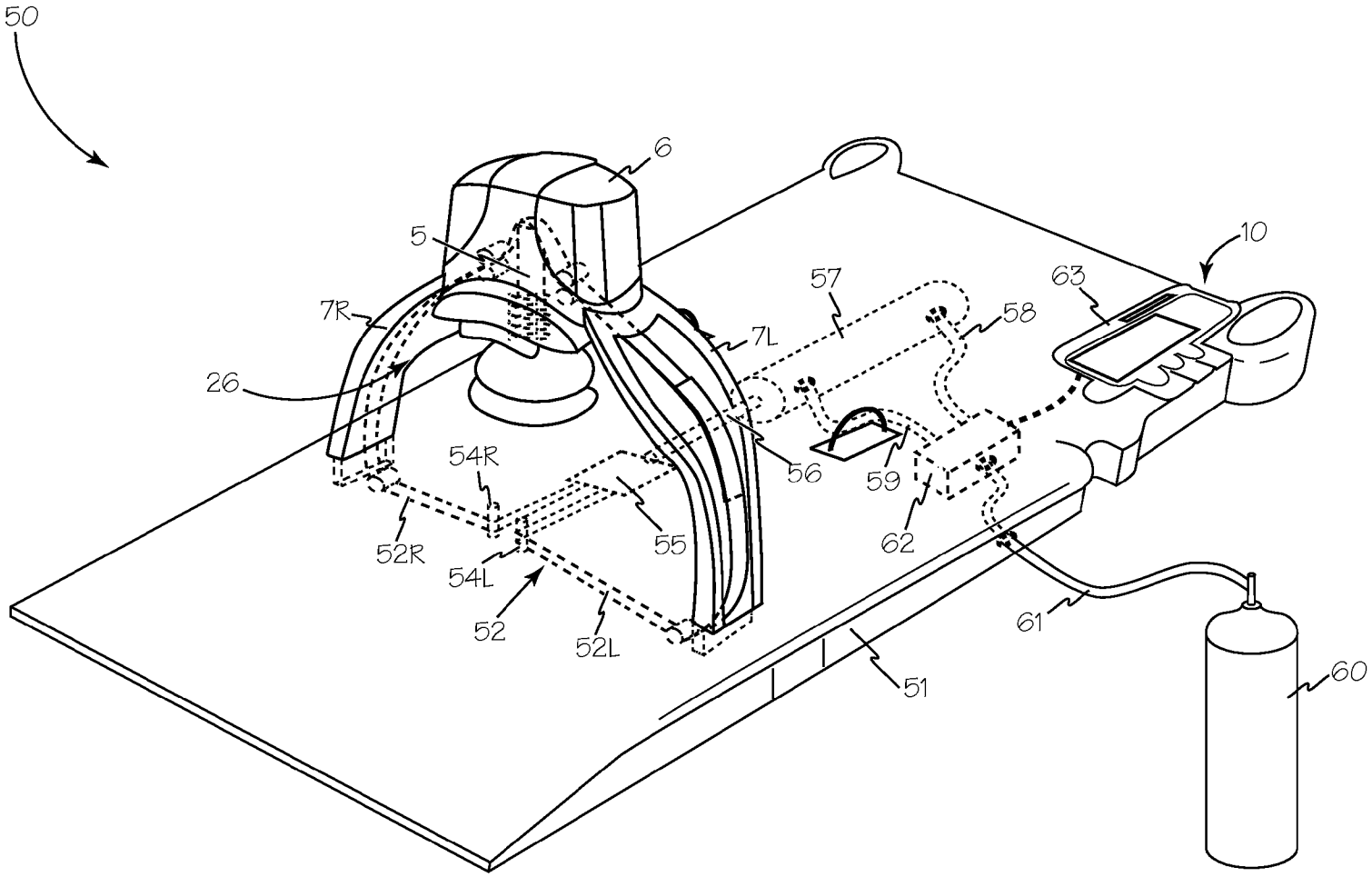
FIG. 6 is a perspective view of a chest compression device with a pneumatic piston drive.

FIG. 6 shows an automatic chest compression device 50 with a pneumatic drive system as illustrated in our copending U.S. patent application Ser. No. 13/234,980 filed Sep. 16, 2011 which is incorporated herein by reference in its entirety. Chest compression device 50 includes a backboard 51, with the belt 52, which has a right belt portion 52R and a left belt portion 52L. Right and left belt portions 52L and 52R extend around vertically oriented spindles 54L and 54R and then extend along the superior/inferior (head-to-toe vis-à-vis the patient) axis the of the device to joint 55 which secures the belt to actuator rod 56 which also extends along the superior/inferior axis of the device to a pneumatic piston 57. The pneumatic piston is operable to pull the rod superiorly (upward relative to the patient) and thereby tighten the band which extends piston 5 to compress the patient's chest, and push the rod inferiorly (downward relative to the patient). The pneumatic piston is supplied with fluid through hoses 58 and 59, communicating with a pressurized fluid source 60 through input hose 61 and valve 62. The valve may be controlled through control system 63 and interface 10. Using commonly available 150 psi (10.2 atmospheres) air supply, and an actuator with a volume of approximately 10 cubic inches (about 164 milliliters) or larger, and a stroke of about 6 inches (about 15.24 cm), the piston can pull and push the rod and thus pull and release the straps, such that the compression belt is tightened about the patient at a rate sufficient for CPR and a depth sufficient for CPR (i.e., at resuscitative rate and depth).

The control system may be a computer control system, programmed to control the valve to alternately supply high pressure air to one side of the piston to pull the straps and then supply air to the other side of the piston to release tension on the straps (while in each case venting the other side of the piston), or an electromechanical control system. The control system may be a microprocessor or separate computer system, integrated into the backboard or a separate computer control system located remotely. To provide feedback regarding the effect of compressions, the load plate and load cells shown in our U.S. Pat. No. 7,347,832 may be placed on the upper surface of the platform, such that it is disposed under the patient's thorax when the system is installed on a patient. Also, a compression depth monitor may be used to provide feedback regarding the effect of compressions, as disclosed in out U.S. Pat. No. 7,122,014.

To effectuate the slack take-up function disclosed in our U.S. Pat. No. 6,616,620, the position of the actuator rod 56 can be detected with a linear encoder system, with an index on the actuator rod and a nearby encoder reader mounted within the platform, with an linear variable differential transformer (LVDT), string potentiometer, or other means for detecting the linear position of the actuator rod, or with the load cells. The point at which the belt has been tightened and there is no slack in the belt around the patient, and the belt is merely snug about the patient but has not exerted significant compressive force on the patient's chest, may be detected by sensing a rapid increase in the actuator pressure, a slow-down in the movement of the actuator rod (as determined by the encoder, LVDT or other means for detecting the linear position of the actuator rod, or a sharp initial increase in load on the load plate and load sensor. The control system may be programmed to detect such signals indicative of the point at which slack has been taken up, and establish the corresponding position of the actuator rod as a starting point for compressions.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A device for performing mechanical cardiopulmonary resuscitation on a patient comprising:

a backboard;

a motor and a drive spool housed within the backboard, wherein the motor is operably secured to the drive spool;

a piston support frame having two legs and a piston actuator housing, the piston support frame secured to the backboard forming a channel between the two legs, the backboard and the piston actuator housing;

a piston operably housed within the piston actuator housing;

a belt enclosed within the backboard and the piston support frame, the belt is operably secured to the drive spool;

wherein actuation of the motor results in cyclic rotation and counter-rotation of the motor and corresponding winding and unwinding of the belt on the drive spool to effectuate cyclic extension and retraction of the piston against the patient's chest to perform mechanical cardiopulmonary resuscitation.

2. The device of claim 1 further comprising:

a controller to control actuation and operation of the motor.

3. The device of claim 2 further comprising:

a plurality of guide spindles in the backboard and the piston support frame for guiding the belt and forming a belt path through the backboard and the piston support frame.

4. The device of claim 1 further comprising:

a spring operably engaging the piston and urging the piston into a retracted position.

* * * * *